US006186844B1

(12) United States Patent
Yonezawa et al.

(10) Patent No.: US 6,186,844 B1
(45) Date of Patent: Feb. 13, 2001

(54) OUTBOARD MOTOR

(75) Inventors: Atsushi Yonezawa; Jiro Saiga, both of Hamamatsu (JP)

(73) Assignee: Suzuki Kabushiki Kaisha, Hamamatsu (JP)

( * ) Notice: Under 35 U.S.C. 154(b), the term of this patent shall be extended for 0 days.

(21) Appl. No.: 09/353,139

(22) Filed: Jul. 14, 1999

(30) Foreign Application Priority Data

Jul. 15, 1998 (JP) ..... 10-200988

(51) Int. Cl.[7] ..... B63H 1/15
(52) U.S. Cl. ..... 440/52; 440/900
(58) Field of Search ..... 440/52, 900; 123/192.1, 123/192.2; 74/603, 604, 605

(56) References Cited

U.S. PATENT DOCUMENTS 4,846,124 * 7/1989 Suzuki et al. ..... 123/192 B
5,309,877 * 5/1994 Shigedomi et al. ..... 123/19.5 P
5,401,199 * 3/1995 Shibata ..... 440/52
5,461,940 * 10/1995 Morita ..... 74/603
5,537,968 * 7/1996 Takahashi ..... 123/192.2

* cited by examiner

*Primary Examiner*—S. Joseph Morano
*Assistant Examiner*—Ajay Vasudeva
(74) *Attorney, Agent, or Firm*—Oblon, Spivak, McClelland, Maier & Neustadt, P.C.

(57) ABSTRACT

In an outboard motor, a balancer shaft is arranged in a crank chamber substantially in parallel to a crank shaft disposed in an engine unit so as to extend perpendicularly in an operative state of an outboard motor and end portions of the balancer shaft are supported by bearings. The end portions of the crank shaft and the balancer shaft are covered and sealed by a seal member straddling over both the end portions thereof.

5 Claims, 6 Drawing Sheets

OUTBOARD MOTOR

BACKGROUND OF THE INVENTION

The present invention relates to an outboard motor particularly provided with a balancer device having an improved arrangement.

An outboard motor is generally equipped with an engine or engine unit which is driven through an operation of a piston-cylinder assembly and generates a primary vibration caused by reciprocal motion of a piston. In order to eliminate such vibration, an outboard motor is provided with a balancer or balancer device.

The balancer is generally composed of a balancer weight which is mounted to a balancer shaft arranged in parallel to a crank shaft disposed inside the engine and which has a weight corresponding to the total weight of the piston, a connection rod and so on. The balancer shaft is driven in association with the driving motion of the crank shaft thereby to remove the primary vibration at the time of the engine operation.

However, in a general structure of the engine of an outboard motor, the balancer shaft is arranged substantially perpendicularly as well as the crank shaft, which causes problems of sealing and/or lubricating an upper bearing portion of the balancer shaft.

In a prior art, although the sealing and lubrication of the bearing portion of the crank shaft have been sufficiently considered, those of the balancer shaft have not been sufficiently considered.

SUMMARY OF THE INVENTION

An object of the present invention is to substantially eliminate defects or drawbacks encountered in the prior art mentioned above and to provide an outboard motor provided with an improved arrangement of the balancer device for achieving the sealing and lubricating an upper bearing portion of a balancer shaft with a simple structure.

This and other objects can be achieved according to the present invention by providing, in one aspect, an outboard motor of a structure in which a balancer shaft is arranged in a crank chamber of an engine unit substantially in parallel to a crank shaft disposed therein so as to perpendicularly extend in an operative state of an outboard motor and end portions of the balancer shaft are supported by bearing means, wherein end portions of the crank shaft and the balancer shaft are covered and sealed by a seal member straddling over both the end portions thereof.

In this aspect, the seal member has a back surface having a portion directly above the end portion of the balancer shaft at which an oil reservoir is formed and another oil reservoir is formed to a portion surrounding the crank shaft, the one and another oil reservoirs being communicated with each other by means of communication passage formed to the back surface of the seal member thereby to guide a lubrication oil introduced to the crank shaft to the bearing means supporting the balancer shaft.

In a more detailed aspect, there is provided an outboard comprising:

an engine holder;

an engine unit disposed above the engine holder so as to be held by the engine holder in a usable state of an outboard motor, said engine unit including a cylinder head, a cylinder block and a crank case having a crank chamber in which a crank shaft extends perpendicularly;

a balancer device disposed in association with the crank shaft so as to remove vibration generated at a time of engine operation, said balancer means including a balancer shaft disposed in the crank chamber substantially parallel to the crank shaft, said balancer shaft being supported by means of bearing and operatively rotated in association with rotation of the crank shaft; and a seal member mounted to the crank chamber straddling over end portions of the crank shaft and the balancer shaft so as to seal both the end portions.

In this aspect, the seal member is an oil seal housing having a flat plate member straddling over end portions of the crank shaft and the balancer shaft so as to seal both the end portions of the crank shaft and the balancer shaft.

The outboard motor further includes a lubrication structure including a first reservoir formed to the flat plate member at a portion directly above the end portion of the balancer shaft, a second oil reservoir formed to a portion surrounding the crank shaft, and a communication passage, for communicating the first and second oil reservoirs with each other, formed to a back surface of the plate member thereby to guide a lubrication oil introduced to the crank shaft to the bearing means supporting the balancer shaft. The communication passage is formed as a groove.

According to the structure of the preferred embodiment of the present invention described above, the upper portions of the crank shaft and the balancer shaft disposed inside the crank chamber formed by mating the cylinder block and the crank case are sealed by the oil seal member having the flat plate member covering both the upper ends of the crank shaft and the balancer shaft, so that the bearing portions of both the shafts can be sealed with a few members through easy assembling process, resulting in a cost reducing.

Furthermore, the communication passage groove is formed so as to establish the communication between both the oil reservoirs formed to the portion directly above the balancer shaft and the surrounding of the crank shaft, respectively, so that the lubrication oil guided to the crank shaft is guided to the ball bearings supporting the balancer shaft. According to such structure, it is not necessary to locate any private oil lubrication passage for the bearings supporting the balancer shaft, thus being convenient and economical in manufacturing cost.

The nature and further characteristic features of the present invention will be made more clear from the following descriptions made with reference to the accompanying drawings.

DESCRIPTION OF THE PREFERRED EMBODIMENT

Figure 1:
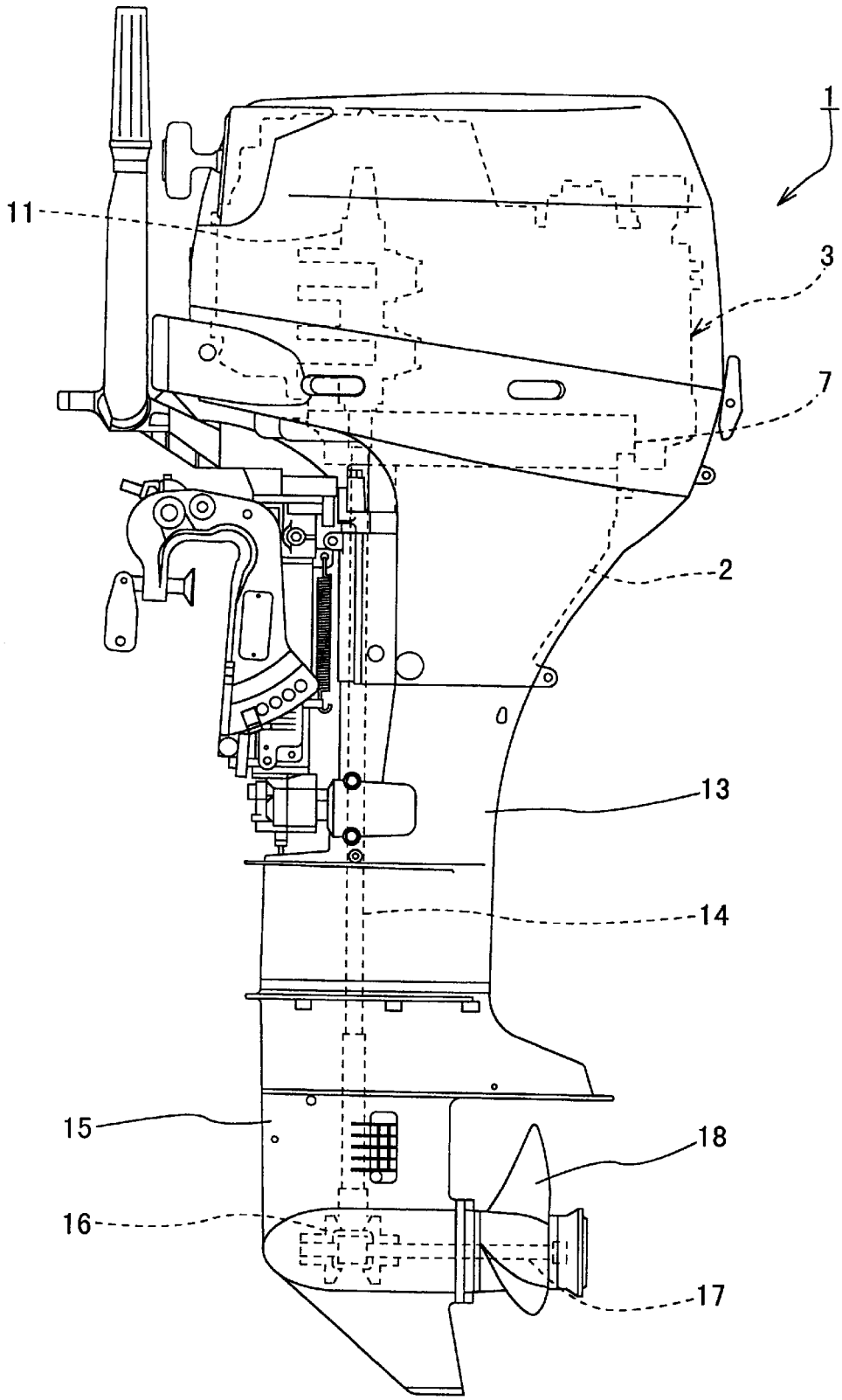
FIG. 1 is a left side view of an outboard motor, in a state mounted to, for example, a hull, having a balancer device of the present invention.
Figure 2:
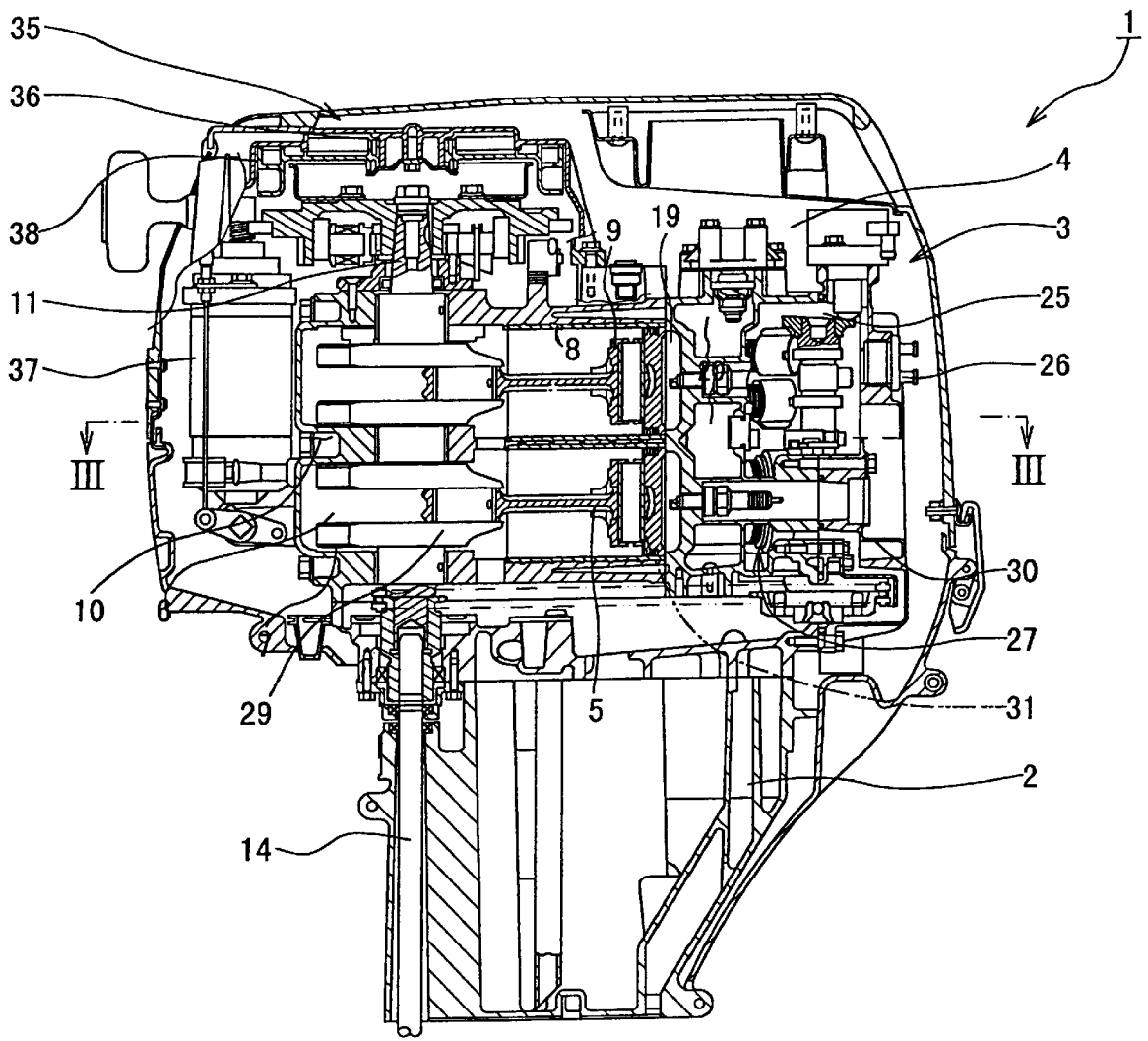
FIG. 2 is an elevational section of an upper half of the outboard motor.

With reference to FIGS. 1 and 2, an outboard motor 1 of the present invention is provided with an oil pan 2 also acting as an engine holder and an engine or engine unit 3 disposed above the engine holder 2 to be held thereby.

The described engine 3 is, for example, a water-cooled four-stroke-cycle two-cylinder engine and is composed of a cylinder head 4, a cylinder block 5, a crank case 6, etc. which are assembled in unit. The engine or engine unit 3 is disposed above the oil pan 2 through a cam chain case 7, which is disposed below the crank case 6, the cylinder block 5 and the cylinder head 4.

The crank case 6 is disposed at the most front side (hull side) of the engine 3 and the cylinder block 5 is disposed to the rear (right side in FIG. 2) portion of the crank case 6. The cylinder head 4 is disposed to the rear side portion of the cylinder block 5.

A cylinder 8 is formed in the cylinder block 5 of the engine 3 to be horizontal and a piston 9 is fitted into the cylinder 8 to be axially reciprocal. A crank chamber 10 is formed in a mating, i.e. joining, portion of the crank case 6 and the cylinder block 5, and a crank shaft 11 is arranged substantially perpendicularly in the crank chamber 11, which is coupled to the piston 9 by means of connection rod 12 so that the reciprocal stroke of the piston 9 is converted to a rotational motion of the crank shaft 11.

Referring to FIG. 1, a drive shaft housing 13 is arranged to the lower portion of the oil pan 2, and an upper end portion of a drive shaft 12 is connected to the lower end portion of the crank shaft 11 so as to extend inside the drive shaft housing 13. The drive shaft 14 then extends into a gear case 15 and is operatively connected to a bevel gear 16 and a propeller 18 is then driven through a propeller shaft 17.

A combustion chamber 19 is formed to the cylinder head 4 of the engine 3 so as to be aligned with the cylinder 8, and an ignition plug 20 is mounted to the cylinder head 4. Furthermore, in the cylinder head 4, there are also formed an intake port 21 and an exhaust port 22 to be communicated with the combustion chamber 19. An intake valve 23 and an exhaust valve 24 for opening or closing these ports 21 and 22 are also arranged inside the cylinder head 4, and a cam shaft 25 is arranged at a rear portion of the cylinder head 4 so as to open or close these valves 23 and 24. The cylinder head 4 is covered by a head cover 26.

A cam shaft drive mechanism 27 is disposed in the cam chain case 7 below the engine 3 and adapted to rotate and drive the cam shaft 25 by transmitting the rotating force of the crank shaft 11 to the cam shaft 25. For example, The cam shaft drive mechanism 27 is, for example, of a chain drive structure comprising a cam drive sprocket 29 mounted to a coupling member coupling the crank shaft 11 and the drive shaft 14, a cam driven sprocket 30 mounted integrally to a lower end portion of the cam shaft 25 projecting from the lower surface of the engine 3 and a timing chain wound up around the cam drive sprocket 29 and the cam driven sprocket 30.

Figure 3:
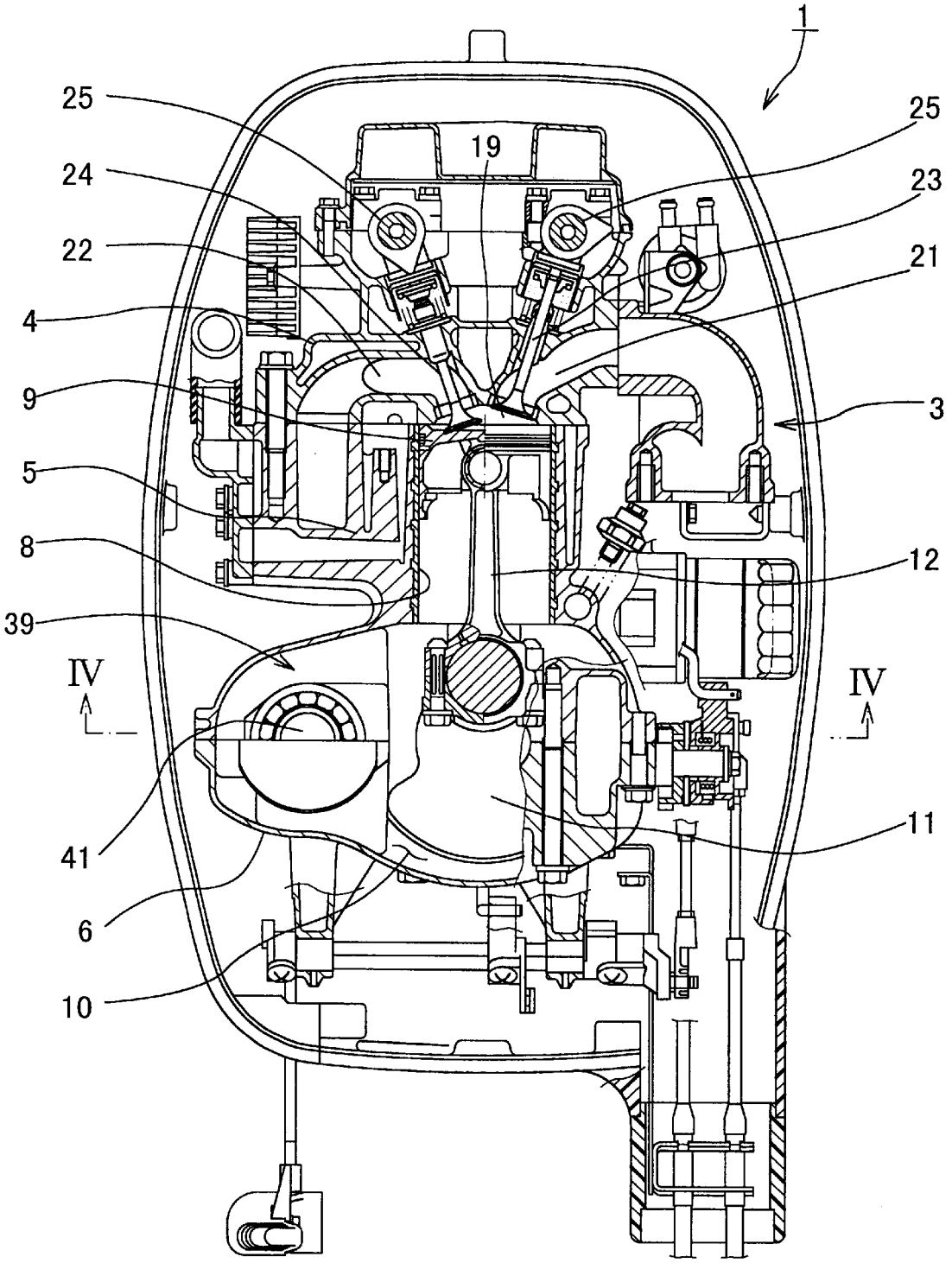
FIG. 3 is a sectional view taken along the line III—III of FIG. 2.
Figure 4:
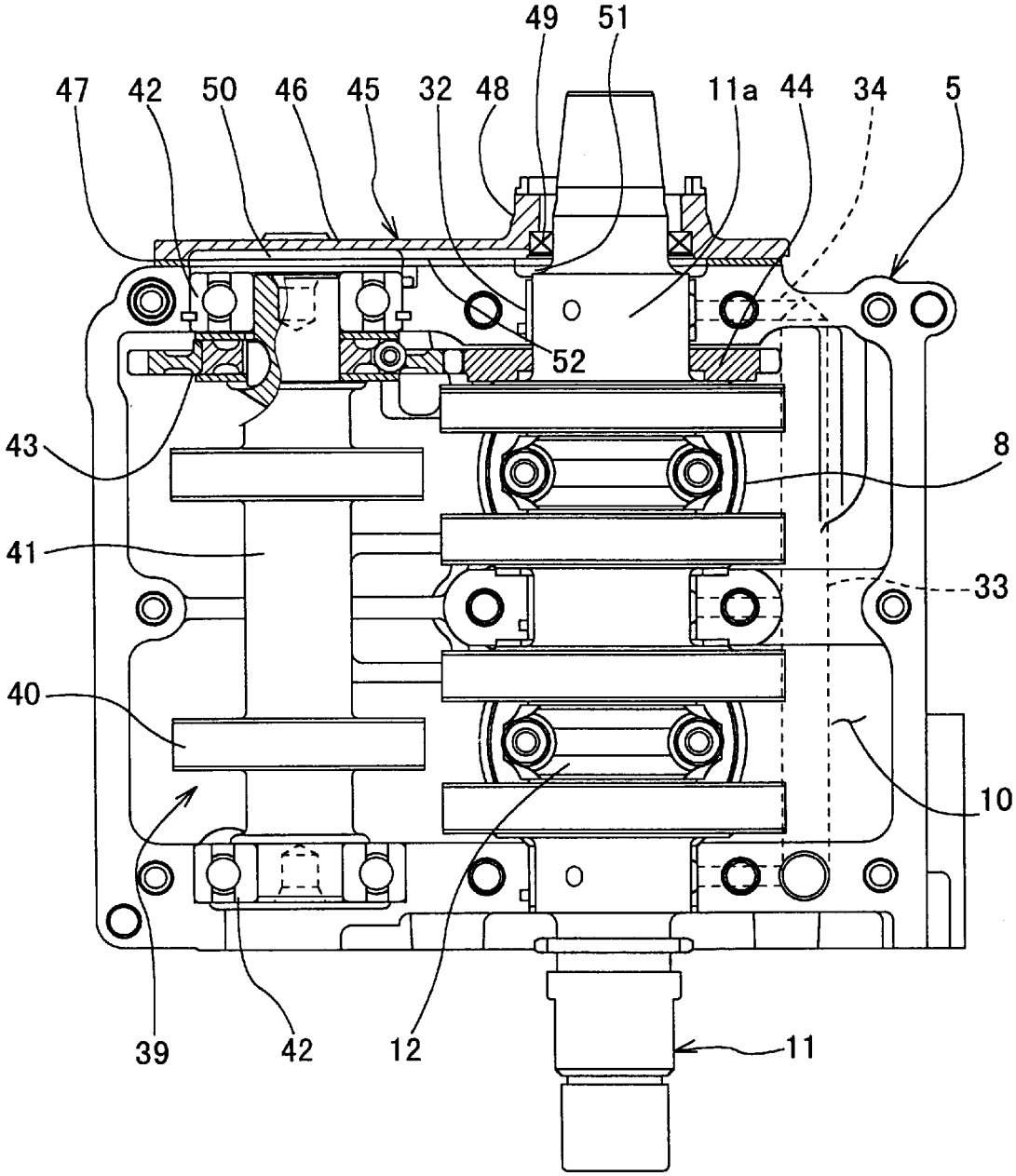
FIG. 4 is a sectional view taken along the line IV—IV of FIG. 3.

With reference to FIG. 4 showing a sectional view taken along the line IV—IV of FIG. 3, the crank shaft 11 has a journal portion 11*a* which is supported by a metal bearing 32, for example, in the crank chamber 10. A main gallery 33 for a lubrication oil is formed in the cylinder block 5 and an oil passage 34 is also formed so as to extend to each of the metal bearings 32 from this main gallery 33.

Further, as shown in FIG. 4, the upper end of the crank shaft 11 projects over the upper portion of the engine 3 and a magneto device 35 for power generation is mounted to the projected portion of the crank shaft 11. The magneto device 35 includes a fly-wheel 36 having an outer periphery to which a link gear 38 is formed to be operatively connected to a starter motor 37 disposed at a front portion of the engine 3.

Incidentally, a primary vibration may easily occur to the engine 3 in accordance with the reciprocal motion of the piston 9 fitted in the cylinder 8. The reason why the balancer device has to be located resides in such generation of vibration.

In order to remove such vibration, a balancer device 39 is arranged according to the present invention and the balancer device 39 has a structure such that a balancer weight 40 having a weight corresponding to the total weight of the piston 9, the connection rod 12 and so on is fixedly mounted to a balancer shaft 41, which is operatively coupled to the crank shaft 11 to be rotated in association with the rotation of the crank shaft 11. According to this structure, the vibration caused during the engine operation can be substantially removed.

The balancer shaft 41 is arranged in the crank chamber 10 to be parallel to the crank shaft 11 in a manner that both end portions thereof are supported by bearing portions such as ball bearings 42. A balancer driven gear 43 is mounted to an upper portion of the balancer shaft 41 so as to be engaged with a balancer drive gear 44 mounted to the crank shaft 11.

Figure 5:
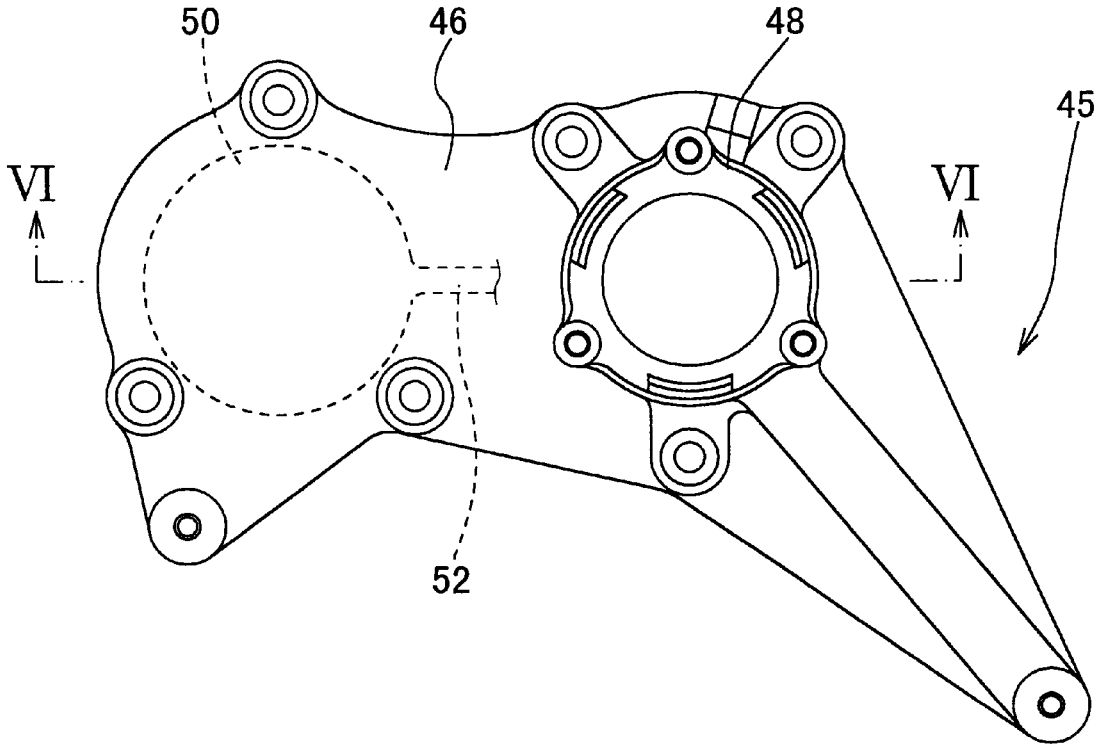
FIG. 5 is a plan view of an oil housing of the outboard motor.
Figure 6:
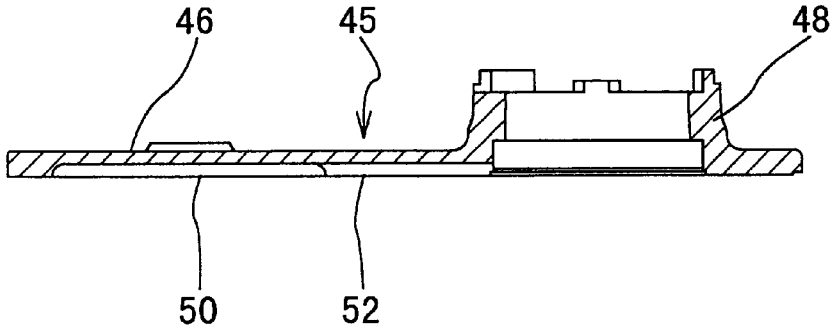
FIG. 6. is a sectional view taken along the line VI—VI of FIG. 5.
Figure 7:
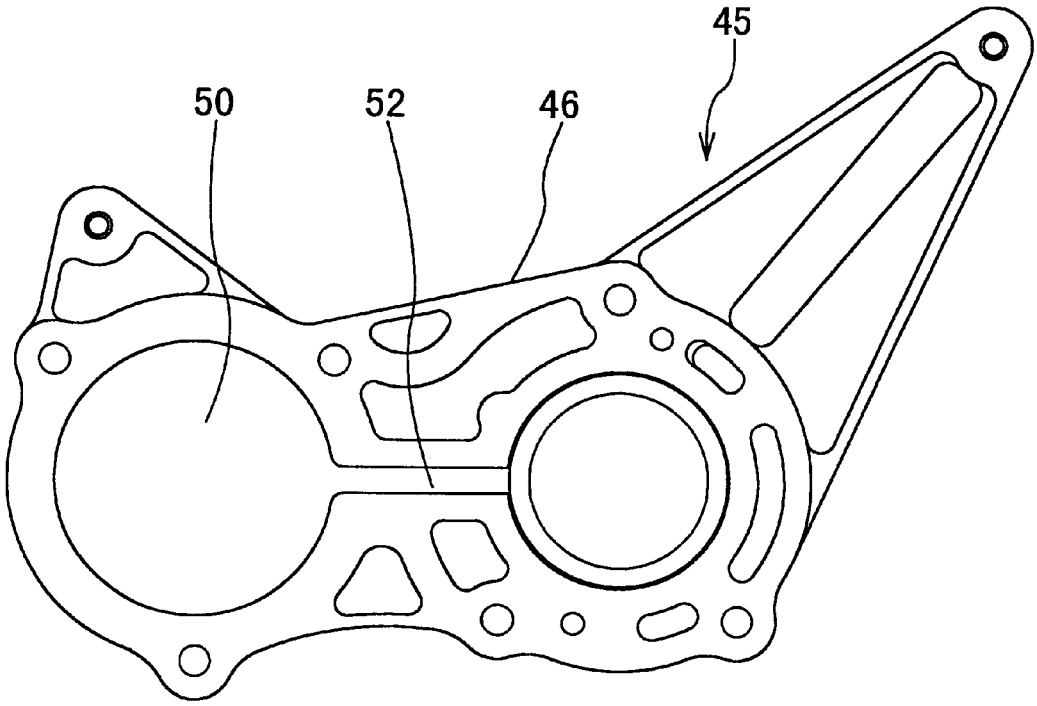
FIG. 7 is a bottom view of the oil housing.

Furthermore, an oil seal housing 45 as a seal member is disposed to the upper surface portion of the crank chamber 10. FIG. 5 shows a view viewed from an upper portion of the oil seal housing 45, FIG. 6 is a sectional view taken along the line VI—VI of FIG. 5 and FIG. 7 is a view viewed from a lower portion thereof.

With reference to FIGS. 4 to 7, the oil seal housing 45 has a flat plate member 46 straddling over both upper portions of the crank shaft 11 and the balancer shaft 41 so as to cover them and is fastened to the upper surfaces of both the cylinder block 5 and the crank case 6 through a gasket 47 by means of bolts, not shown. The flat plate member 46 has an opening at a portion directly above the crank shaft 11 and a tubular boss portion 48 is formed to the opening so that the upper end portion of the crank shaft 11 projects over the boss portion 48. Furthermore, an oil seal 49 is arranged inside the boss portion 48 to keep a fluid seal condition in the crank chamber 10.

Furthermore, a recessed oil reservoir 50 is formed to a back surface side of the plate member 46 at a portion directly above the upper end portion of the balancer shaft 41 so as to provide a shape approximately along the plane shape of the ball bearing 42. Another oil reservoir 51 is formed around the crank shaft 11 at a mating upper portion of the cylinder block 5 and the crank case 6. Both the oil reservoirs 50 and 51 are communicated with each other by means of communication passage 52 in shape of groove formed to the back surface of the plate member 46 and the lubrication oil guided from the main gallery 33 to the crank shaft 11 is then guided through this communication passage 52 to the ball bearings 42 supporting the balancer shaft 41.

According to the structure of the embodiment of the present invention described above, the following functions and effects will be achieved.

The upper portions of the crank shaft 11 and the balancer shaft 41 disposed inside the crank chamber 10 formed by mating the cylinder block 5 and the crank case 6 are sealed by the oil seal housing 45 having the flat plate member 46 covering both the crank shaft 11 and the balancer shaft 41, so that the bearing portions 32 and 42 of both the shafts can be sealed with a few members through easy assembling process, resulting in a cost reducing.

Furthermore, the communication passage groove 52 is formed so as to establish the communication between the oil reservoirs 50 and 51 formed to the portion directly above the balancer shaft 41 and the surrounding of the crank shaft 11, respectively, so that the lubrication oil guided to the crank shaft 11 is then guided to the ball bearings 42 supporting the balancer shaft 41. According to such structure, it is not necessary to locate any private oil lubrication passage for the bearings 42 supporting the balancer shaft 41, thus being convenient and economical in manufacturing cost.

It is to be noted that the present invention is not limited to the described embodiment and many other changes and modifications may be made without departing from the scopes of the appended claims.

What is claimed is:

1. An outboard motor of a structure in which a balancer shaft is arranged in a crank chamber of an engine unit substantially in parallel to a crank shaft disposed therein so as to vertically extend in an operative state of an outboard motor and end portions of said balancer shaft being supported by bearing means, wherein end portions of said crank shaft and said end portions of said balancer shaft are covered and sealed by a seal member straddling over both said end portions of said crank shaft and said balancer shaft, a balancer drive gear being mounted to said crank shaft at a portion inside of said engine unit with a metal bearing of said crank shaft being interposed therebetween, and wherein a first oil reservoir is formed directly above an upper end portion of said balancer shaft and a second oil reservoir is formed around said crank shaft and outside of said engine unit, said first and second oil reservoirs communicating with each other through a passage in a shape of a groove.

2. The outboard motor according to claim 1, wherein said seal member has a back surface having a portion directly above said upper end portion of said balancer shaft at which said first oil reservoir is formed, said passage being formed in said back surface of said seal member to guide a lubrication oil introduced from said crank shaft to said bearing means supporting said balancer shaft.

3. An outboard motor comprising:

an engine holder;

an engine unit disposed above said engine holder so as to be held by said engine holder in a usable state of the outboard motor, said engine unit including a cylinder head, a cylinder block and a crank case having a crank chamber in which a crank shaft extends vertically in an operative state of the outboard motor and is supported by a metal bearing;

a balancer device disposed in association with said crank shaft so a to remove vibration generated at a time of engine operation, said balancer means including a balancer shaft disposed in said crank chamber substantially parallel to said crank shaft, said balancer shaft being supported via a bearing and operatively rotated in association with rotation of said crank shaft, said balancer device being driven by a balancer drive gear mounted to said crank shaft at a portion inside of said engine unit with said metal bearing being interposed therebetween;

a seal member mounted on said crank chamber straddling over end portions of said crank shaft and said balancer shaft so as to seal both of said end portions;

a first oil reservoir disposed directly above an upper end of said balancer shaft; and a second oil reservoir formed around said crank shaft and outside of said engine unit, said first and second oil reservoirs communicating with each other through a passage in a shape of a groove.

4. The outboard motor according to claim 3, wherein said seal member is an oil seal housing having a flat plate member straddling over both said end portions of said crank shaft and said balancer shaft so as to seal both said end portions of said crank shaft and said balancer shaft.

5. The outboard motor according to claim 4, further comprising lubrication means including said first reservoir formed in said flat plate member at a portion directly above said upper end portion of said balancer shaft, said second oil reservoir formed in said portion surrounding said crank shaft, and said passage for allowing said first oil reservoir to communicate with said second oil reservoir, said passage being formed in a back surface of said flat plate member to guide a lubrication oil introduced from said crank shaft to said bearing means supporting said balancer shaft.

* * * * *